US006384007B1

(12) United States Patent
Convents et al.

(10) Patent No.: US 6,384,007 B1
(45) Date of Patent: May 7, 2002

(54) METHOD AND COMPOSITION FOR ENHANCING THE ACTIVITY OF AN ENZYME

(75) Inventors: Daniel Convents; Monique Doornink; Jean Hypolites Koek, all of Vlaardingen (NL); David William Thornthwaite, Bebington (GB); Nicole Zwets, Vlaardingen (NL)

(73) Assignee: Unilever Home & Personal USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/709,172

(22) Filed: Nov. 9, 2000

(30) Foreign Application Priority Data

Nov. 11, 1999 (EP) ..... 99203773

(51) Int. Cl.[7] ..... C11D 7/42; C11D 3/386; C11D 3/26; C11D 3/39

(52) U.S. Cl. ..... 510/392; 510/305; 510/306; 510/311; 510/320; 510/393; 510/374; 510/375; 510/530; 8/137; 8/401; 435/189; 435/183

(58) Field of Search ..... 510/392, 305, 510/306, 311, 320, 393, 374, 375, 530; 435/183, 189; 8/137, 401

(56) References Cited

U.S. PATENT DOCUMENTS

| | | | | |
|---|---|---|---|---|
| 4,690,895 A | | 9/1987 | Farrell | 435/278 |
| 5,851,233 A | | 12/1998 | Pedersen et al. | 8/102 |
| 6,169,065 B1 | * | 1/2001 | Antheunisse et al. | 510/392 |

FOREIGN PATENT DOCUMENTS

| | | | | |
|---|---|---|---|---|
| DE | 44 45 088 | | 6/1996 | |
| EP | 424 398 | | 5/1991 | |
| GB | 1234335 | * | 6/1971 | 3/38 |
| WO | 91/05839 | | 5/1991 | |
| WO | 94/12619 | | 6/1994 | |
| WO | 94/12620 | | 6/1994 | |
| WO | 94/12621 | | 6/1994 | |
| WO | 97/06244 | | 2/1997 | |
| WO | 97/11217 | | 3/1997 | |
| WO | 98/51772 | | 11/1998 | |

OTHER PUBLICATIONS

PCT International Search Report in a PCT application PCT/EP 00/10425. No date.
Derwent Abstract of WO 98/51772—published Nov. 19, 1998.
Derwent Abstract of DE 44 45 088—published Jun. 20, 1996.
Co–pending application: Convents et al., Ser. No. 09/709,173; Filed—Nov. 9, 2000.
Co–pending application: Breel et al., Ser. No. 09/596,998; Filed—Jun. 20, 2000.
Co–pending application: Breel et al., Ser. No. 09/596,994; Filed—Jun. 20, 2000.

* cited by examiner

*Primary Examiner*—Lorna M. Douyon
*Assistant Examiner*—Eisa Elhilo
(74) *Attorney, Agent, or Firm*—Rimma Mitelman

(57) ABSTRACT

There is provided a process for enhancing the activity of a phenol oxidizing enzyme, comprising adding to the enzyme, as an enhancer for the activity of said enzyme, one or more compounds having the having the formula:

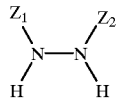

wherein $Z_1$ and $Z_2$ are electron withdrawing groups, independently selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile. The process is especially useful for removing colored stains from fabrics in a washing process.

18 Claims, No Drawings

METHOD AND COMPOSITION FOR ENHANCING THE ACTIVITY OF AN ENZYME

TECHNICAL FIELD

The present invention generally relates to the activation of redox enzymes by means of enhancing agents. More in particular, the invention is concerned with the activation of phenol oxidizing enzymes, especially in a process for bleaching stains on fabrics during washing.

BACKGROUND AND PRIOR ART

Redox enzymes are enzymes that catalyze the transfer of electrons from an electron donor to an electron acceptor. In the case of phenol oxidizing enzymes, the electron donor is usually a phenolic compound and the electron acceptor is molecular oxygen or hydrogen peroxide, which is thereby reduced to $H_2O$. Phenol oxidizing enzymes are capable of using a wide variety of different phenolic compounds as electron donors, but they are very specific for molecular oxygen or hydrogen peroxide as the electron acceptor.

Examples of phenol oxidizing enzymes which use molecular oxygen as electron acceptor are laccases (EC 1.10.3.2), bilirubin oxidases (EC 1.3.3.5), mono phenol oxidizing enzymes (EC 1.14.18.1), catechol oxidases (EC 1.10.3.1). Phenol oxidizing enzymes that use hydrogen peroxide as electron acceptor are called peroxidases.

Phenol oxidizing enzymes can be utilized for a wide variety of applications, including the detergent industry, the paper and pulp industry (U.S. Pat. No. 4,690,895), the textile industry and the food industry. In the detergent industry, phenol-oxidizing enzymes have been used for preventing the transfer of dyes in solution from one textile to another during detergent washing, an application commonly referred to as dye transfer inhibition.

For example, the use of peroxidases for bleaching fabrics during washing has been suggested in EP-A-424 398 (Novo Nordisk). WO-A-91/05839 (Novo Nordisk) describes the inhibition of dye transfer during the wash by means of peroxidase or an enzyme exhibiting oxidase activity on phenolic compounds. The compositions are said to bleach any dissolved textile dye so that no dye can redeposit upon the fabric.

It is also known that the activity of phenol oxidizing enzymes may be increased by the addition of certain organic compounds. The use of such activated enzyme systems for various purposes has also been described, for instance for inhibiting dye transfer in a washing process. The above mentioned WO-A-91/05839 (Novo Nordisk) describes that the addition of another oxidisable substrate may enhance the enzyme activity. Examples of such oxidisable substrates or "enhancers" are certain phenolic compounds, e.g. 2,4-dichlorophenol.

In three subsequent patent applications (WO-A-94/12619, WO-A-94/12620 and WO-A-94/12621, all Novo Nordisk) it is disclosed that the action of peroxidase in such anti dye-transfer compositions may be enhanced by the addition of a number of aromatic compounds, of which 2,2'-azo-bis-(3-ethylbenzo-thiazoline-6-sulphonate (ABTS) and Phenothiazine-10-propionate (PTP) appear to be the preferred compounds. WO-A-97/11217 (Novo Nordisk) discloses a process for bleaching stains by contacting the fabric in an aqueous medium with a phenol oxidizing enzyme and a "mediator", which is preferably of the phenotiazine-type.

However, some of these aromatic enhancer compounds may not be attractive as ingredients of detergent compositions for economical or environmental reasons. Furthermore, some of these enhancers like ABTS are, in their oxidized form, dyestuffs themselves. This has the disadvantage that the washed fabrics may be coloured by residual amounts of oxidised ABTS.

WO-A-97/06244 (Ciba) discloses various other compounds as enhancers for phenol oxidizing enzyme such as substituted naphtols, barbituric acids, and substituted coumarins.

Although some of these approaches have been successful to a certain extent, there is still a need for alternative or improved enhancers for the activity of phenol oxidizing enzymes. In particular, there is a need for effective enhancers which are colourless before and after use.

Furthermore, there is a need for effective enzymatic bleach compositions, e.g. enzymatic bleaching detergent compositions. It is therefor an object of the present invention to provide such effective alternative or improved phenol oxidizing enzyme enhancers and enzymatic bleach compositions containing them.

We have now surprisingly found that these and other objects can be achieved by using certain hydrazine or N-N-containing compounds as phenol oxidizing enzyme enhancers.

DEFINITION OF THE INVENTION

According to a first aspect of the invention, there is provided a process for enhancing the activity of a phenol oxidizing enzyme, comprising adding to the enzyme, as an enhancer for the activity of said enzyme, one or more compounds having the having the formula:

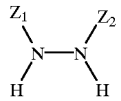

wherein $Z_1$ and $Z_2$ are electron withdrawing groups, independently selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile.

According to a second aspect, there is provided an enzymatic bleach composition comprising a phenol oxidizing enzyme and an enhancer, as shown above. According to a third aspect, there is provided a detergent composition comprising the enzymatic bleach composition and which additionally comprises one or more surfactants. According to a fourth aspect, there is provided a process for bleaching stains on fabrics.

DESCRIPTION OF THE INVENTION

A first aspect of the invention is a process for enhancing the activity of a phenol oxidizing enzyme by adding to the enzyme, certain specific compounds which are capable of enhancing the activity of said phenol oxidizing enzyme, the so-called "enhancers". A second aspect of the invention is formed by enzymatic bleach compositions comprising a phenol oxidizing enzyme and said enhancers.

(a) The Phenol Oxidizing Enzyme

The enzymatic bleach compositions according to the invention comprise, as a first constituent, a phenol-oxidizing enzyme. A phenol-oxidizing enzyme is defined for the purpose of the present invention as an enzyme or a system in which an enzyme, by using hydrogen peroxide or molecular oxygen, is capable of oxidising organic compounds containing phenolic groups. Examples of such enzymes are peroxidases and oxidases. Suitable enzymes are disclosed in EP-A-495 835 (Novo Nordisk). For instance, suitable peroxidases may be isolated from and are producible by plants or micro-organisms such as bacteria or fungi. Preferred fungi are strains belonging to the class of the Basidiomycetes, in particular Coprinus, or to the class of Hyphomycetes, in particular Arthromyces, especially *Arthromyces ramosus*. Other preferred sources are Hormographiella sp. or Soybean peroxidase. Other relevant peroxidases are haloperoxidases (U.S. Pat. No. 4,397,192) such as chloride peroxidases, bromide peroxidases and iodide peroxidases. Other potential sources of useful peroxidases are listed in B. C. Saunders et al., Peroxidases, London, 1964, pp 41–43.

In the context of this invention, phenol oxidizing enzymes which use oxygen as the oxidant, comprise any laccase comprised by the enzyme classification (EC 1.10.3.2), any catechol oxidase enzyme comprised by the enzyme classification (EC 1.10.3.1), any bilirubin oxidase enzyme comprised by the enzyme classification (EC 1.3.3.5) or any monophenol monooxygenase enzyme comprised by the enzyme classification (EC 1.14.99.1). The phenol oxidizing enzymes are known from microbial and plant origin. The microbial phenol oxidizing enzyme may be derived from bacteria or fungi (including filamentous fungi and yeasts) and suitable examples include a phenol oxidizing enzyme derivable from a strain of Aspergillus, Neurospora, e.g. *N. crasse,* Podospora, Botrytis, Collybia, Fomes, Lentinus, Pleurotus, Trametes, (previously called Polyporus), e.g. *T. villosa* and *T. versicolor,* Rhizoctonia, e.g. *R. solani,* Coprinus, e.g. *C. plicatilis* and *C. cinereus,* Psatyrella, Myceliophthora, e.g. *M. thermophylia,* Schytalidium, Phlebia, e.g. *P. radita* (WO-A-92/01046), Coriolus, e.g. *C. hirsutus* (JP-A-2-238885), Acremonium, e.g. *A. murorum* (WO-A-00/05349)or Stachybotrys, e.g. *Stachybotrys chartarum* or *Stachybotrys parvispora* (WO-A-99/49010) (Unilever).

The phenol oxidizing enzyme may furthermore be one which is reproducible by a method comprising cultivating a host cell transformed with a recombinant DNA vector which carried a DNA sequence encoding said phenol oxidizing enzyme as well as DNA sequence encoding functions permitting the expression of the DNA sequence encoding phenol oxidizing enzyme, in a culture medium under conditions permitting the expression of the phenol oxidizing enzyme and the recovery of the phenol oxidizing enzyme from the culture.

Also of interest are synthetic or semi-synthetic derivatives and models of such enzymes, such as those comprising iron- or manganese-porphyrin systems, microperoxidases, and iron- or manganese-phthalocyanine compounds, e.g. as described in U.S. Pat. No. 4,077,768, WO-A-91/05858 and WO-A-92/16634.

(b) The Source of Hydrogen Peroxide

When a peroxidase is used in the enzymatic bleach compositions according to the invention, it is necessary to include a source of hydrogen peroxide. This may be hydrogen peroxide itself, but more stabilised forms of hydrogen peroxide such as perborate or percarbonate are preferred. Especially preferred is sodium percarbonate.

Alternatively, one may employ an enzymatic hydrogen peroxide-generating system. The enzymatic hydrogen peroxide-generating system may in principle be chosen from the various enzymatic hydrogen peroxide-generating systems, which have been disclosed in the art. For example, one may use an amine oxidase and an amine, an amino acid oxidase and an amino acid, cholesterol oxidase and cholesterol, uric acid oxidase and uric acid or a xanthine oxidase with xanthine. In the latter system, superoxide is generated which decomposes to give hydrogen peroxide. Preferably, however, the combination of a $C_1$–$C_4$ alkanol oxidase and a $C_1$–$C_4$ alkanol is used, and especially preferred is the combination of methanol oxidase and ethanol. The methanol oxidase is preferably isolated from a catalase-negative *Hansenula polymorpha* strain. (see for example EP-A-244 920 (Unilever)).

(c) The Enhancer

As further ingredient, the compositions of the invention comprise as an enhancer for the activity of said enzyme, one or more compounds having the formula:

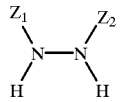

wherein:

$Z_1$ and $Z_2$ are electron withdrawing groups (as described in J. March, "Advanced Organic Chemistry", pg 17, 3d ed. (1985)), independently selected from the group consisting of optionally substituted alkyl/(hetero)aryl--sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile.

Preferably, the enhancer has the formula:

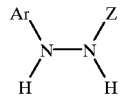

wherein Z is as defined before and Ar is an optionally substituted aromatic or heteroaromatic group e.g. phenyl, phenyl substituted with halogen(s), alkoxy, alkyl, (alkyl) amino substituents, pyridinyl, alkyl-pyridinyl, furanyl.

Especially preferred enhancer compounds have the generic structures:

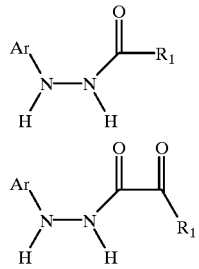

wherein the Ar group is as defined before and $R_1$ is an optionally substituted alkyl, oxyalkyl, aryl or oxyaryl group.

Of particular interest are 2'-phenylbenzohydrazide; Ethyl [2-(3-chlorophenyl)]hydrazide oxalate; Propyl[2-phenyl]-hydrazide oxalate; and Methyl[2-phenyl]hydrazide oxalate.

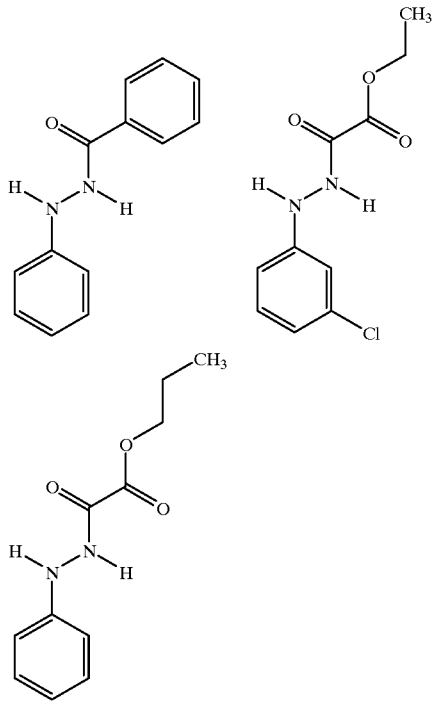

Another, particularly preferred enhancer is N,N'-diphenyl-ethane dihydrazine:

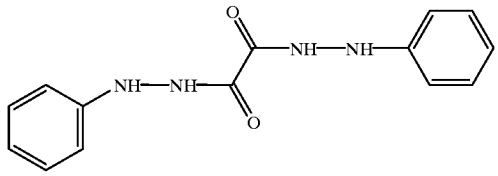

Another class of preferred enhancers has the formula:

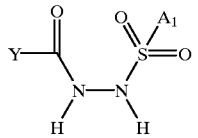

wherein:

Y=optionally substituted aryl or aryl-hydrazidoyl, -amidoyl, -esteroyl, alkanoyl, aroyl, alkyl, aryl and $A_1$=optionally substituted (hetero)aryl or alkyl. Even more preferred are structures having the formula:

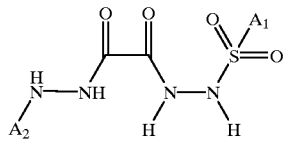

wherein $A_1$ and $A_2$ are independently optionally substituted (hetero)aryl or alkyl.

Most preferred are structures of the previous formula wherein $A_1$ is unsubstituted or para substituted aryl with substitutents nitro, chloro, bromo, fluoro, amino, alkylamido, C1–C6 alkyl optionally branched and substituted, C1–C6 alkoxy optionally branched and substituted, carbamoyl, sulfamoyl, sulfonyl, formyl, carboxyl and esters and salts thereof.

In the above drawing, no specific stereochemistry is implied. A particularly preferred enhancer is Ethanedioic acid, 2-[(4-aminophenyl)sulfonyl)hydrazide-2-phenylhydrazide.

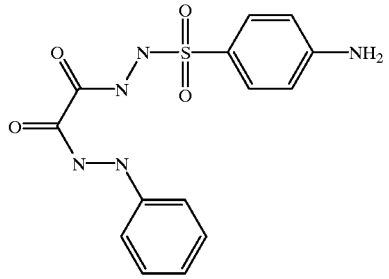

The above compounds can be prepared using standard organic synthesis techniques, see Chemical Abstracts 89:42708 & Chernykh, V.;Farm. Zh. (Kiev) 1977, 4, 67–70.

(d) Applications

The process and the bleach composition of the present invention may in principle be applied in all situations where phenol oxidizing enzymes are now used or have been suggested for use, such as in fabric washing, pulp bleaching in the paper industry and waste water treatment. The invention is of particular use to formulate detergent compositions that are capable of bleaching stains on fabrics during washing, but also to formulate enzymatic anti dye-transfer compositions. The enzymatic bleach compositions and the detergent compositions of the invention may take any suitable physical form, such as a powder, an aqueous or non-aqueous liquid (which may be stuctured or isotropic), a paste, a gel or a tablet. However, granular detergents (powders) are preferred.

The enzymatic bleach compositions of the invention comprise about 0.001 to 50 mg of active enzyme per gram of detergent composition. Preferably, they comprise 0.001 to 5 mg of active enzyme protein per gram of detergent composition, more preferably 0.005 to 1.0 mg per gram. The phenol oxidizing enzymes used in the present invention can usefully be added to detergent compositions in any suitable form, i.e. the form of a granular composition, a liquid or a slurry of the enzyme, with carrier material (e.g. as in EP-A-258 068 and the Savinase(™)and Lipolase(™) products of Novo Nordisk), or a coating. A good way of adding the enzyme to a liquid detergent product is in the form of a slurry containing 0.5 to 50% by weight of the enzyme in a ethoxylated alcohol nonionic surfactant, such as described in EP-A-450 702 (Unilever).

If desired, a slow-release coating may be applied to the granulate of the phenol oxidizing enzyme. By means of such coatings, it is possible to achieve the controlled release of the enzyme when the granulate is introduced in the washing liquor. Preferred slow-release materials are compounds that are substantially insoluble in water. Examples of such materials include long-chain fatty acid mono, di-, triesters of glycerol, ethoxylated fatty alcohols, latexes, waxes, tallow, hydrogenation tallow, partially hydrolyzed tallow, hydrocarbons having a melting point in the range of 50–80° C.

(e) Surfactants

When used to formulate bleaching detergent compositions, the compositions of the invention will usually contain, one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap cationic, anionic and nonionic compounds. Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulpho-succinates; and fatty acid ester sulphonates. Sodium salts are generally preferred. It was found to be advantageous to also include cationic surfactants into the composition. Examples of suitable cationic surfactants are given in WO-A-97/03160 and WO-A-98/17767 (Procter&Gamble).

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 (and preferably 3 to 7) moles of ethylene oxide per mole of alcohol. Non-ethoxylated nonionic surfactants include alkylpolyglycosides, glycerol monoethers, and polyhydroxy-amides (glucamide). If the detergent composition comprises both nonionic and anionic surfactants, it is preferred that the ratio of nonionic surfactant to anionic surfactant is at least 1 to 3, more preferably at least 1 to 1.

The choice of detergent-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60% by weight, for example, in a composition for washing fabrics by hand. In compositions for machine washing of fabrics, an amount of from 5 to 40% by weight is generally appropriate. Detergent compositions suitable for use in most automatic fabric washing machines generally contain anionic non-soap surfactant, or nonionic surfactant, or combinations of the two in any ratio, optionally together with soap.

(f) Detergency Builders

The enzymatic bleach compositions of the invention will generally also contain one or more detergency builders. This detergency builder may be any material capable of reducing the level of free calcium ions in the wash liquor and will preferably provide the composition with other beneficial properties such as the generation of an alkaline pH, the suspension of soil removed from the fabric and the suspension of the fabric-softening clay material. The total amount of detergency builder in the compositions will suitably range from 5 to 80%, preferably from 10 to 60% by weight. Inorganic builders that may be present include sodium carbonate, if desired in combination with a crystallisation seed for calcium carbonate, as disclosed in GB-A-1 437 950 (Unilever); crystalline and amorphous aluminosilicates, for example, zeolites as disclosed in GB-A-1 473 201 (Henkel), amorphous aluminosilicates as disclosed in GB-A-1 473 202 (Henkel) and mixed crystalline/amorphous aluminosilicates as disclosed in GB-A-1 470 250 (Procter & Gamble); and layered silicates as disclosed in EP-B-164 (Hacksawed). Inorganic phosphate builders, for example, sodium orthophosphate, pyrophosphate and tripolyphosphate, may also be present, but on environmental grounds those are no longer preferred.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50% by weight. The alkali metal aluminosilicate may be either crystalline or amorphous or mixtures thereof, having the general formula:

$$0.8\text{–}1.5\ Na_2O.Al_2O_3.0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB-A-1 429 143 (Proctor & Gamble). The preferred sodium aluminosilicates of this type are the well-known commercially available zeolites A and X, and mixtures thereof. The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP-A-384 070 (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20. Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyl-iminodiacetates, alkyl- and alkenylmalonates and succinates; and sulphonated fatty acid salts.

Especially preferred organic builders are citrates, suitably used in amounts of from 5 to 30% by weight, preferably from 10 to 25% by weight, and acrylic polymers, more especially acrylic/maleic copolymers, suitably used in amounts of from 0.5 to 15%, preferably from 1 to 10% by weight. Builders, both inorganic and organic, are preferably present in the form of their alkali metal salt, especially their sodium salt.

(g) Bleach Components

Detergent compositions according to the invention may additionally contain a conventional bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilization by moisture. Sodium percarbonate having a protective coating comprising sodium metaborate and sodium silicate is disclosed in GB-A-2 123 044 (Kao). The peroxy bleach compound is suitably present in an amount of from 5 to 35 wt %, preferably from 10 to 25 wt %.

The bleach system may contain apart from the hydrogen peroxide source, as disclosed above, also a peracid-forming bleach activator or precursor to improve bleaching action at low wash temperatures. Preferred bleach precursors are peroxycarboxylic acid precursors, more especially peracetic acid precursors and peroxybenzoic acid precursors; and peroxycarbonic acid precursors. Of special interest or bleach activators such as tetraacetylethylenediamine (TAED) or N,N-phthaloylaminoperoxy caproic acid (PAP). The novel quaternary ammonium and phosphonium bleach precursors disclosed in U.S. Pat. Nos. 4,751,015 and U.S. Pat. No. 4,818,426 (Lever Brothers Company) and EP-A-402 971 (Unilever) are also of great interest. Alternatively, peroxycarbonic acid precursors, in particular cholyl-4-sulphophenyl carbonate can be used. Also of interest are peroxybenzoic acid precursors, in particular, N,N,N-trimethylammonium toluoyloxy benzene sulphonate; and the cationic bleach precursors disclosed in EP-A-284 292 and EP-A-303 520 (Kao). The bleach precursor is suitably present in an amount of from 1 to 8 wt %, preferably from 2 to 5 wt %.

Alternatively, inorganic peroxyacids like potassium monopersulphate (MPS) may be employed. Alkyl hydroperoxides are another class of peroxy bleaching compounds. Examples of these materials include t-butyl hydroperoxide and cumene hydroperoxide.

Optionally, bleach catalysts can be included. Such compounds are well known in the art and include, for example, manganese-based catalysts as disclosed in U.S. Pat. Nos. 5,246,621, 5,244,594, 5,194,416, 5,114,606, EP-A-458 397 and EP-A-458 398 EP-A-509 787 or the iron-based catalysts as disclosed in WO-A-95/34628.

WO-A-00/12667 (Unilever) discloses a method of bleaching a fabrics comprising applying to the substrate, in an aqueous medium, an organic substance which forms a complex with a transition metal, the complex catalysing bleaching of the substrate by atmospheric oxygen.

A bleach stabilizer (heavy metal sequestrant) may also be present. Suitable bleach stabilizers include ethylenediamine tetraacetate (EDTA) and the polyphosphonates such as Dequest (Trade Mark), EDTMP.

(h) Additional Enzymes

The detergent compositions of the present invention may additionally comprise one or more further enzymes which provide detergent performance and/or fabric care benefits.

Said enzymes include enzymes selected from hemicellulases, peroxidases, proteases, gluco-amylases, amylases, xylanases, lipases, phospholipase, esterases, cutinases, pectinases, polygalacturonase, keratanases, reductases, oxidases, phenoloxidases, lipoxygenases, ligninases, pullulanases, tannases, pentosanases, malanases, arabinosidases, hyaluronidase, chondroitinase or mixtures thereof.

A preferred combination is a detergent composition having cocktail of conventional applicable enzymes like protease, amylase, lipase, cutinase and/or cellulase in conjunction with one or more plant cell wall degrading enzymes.

Preferred proteolytic enzymes (proteases) are normally solid, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins, which are obtained from particular strains of *B. subtilis* and *B. licheniformis,* such as the commercially available subtilisins Savinase™, Alcalase™ and Durazyme™ as supplied by Novo Industri A/S, Copenhagen, Denmark or Purafect™ and Properase™ as supplied by Genencor International.

Suitable lipases are Lipolase™, Lipolase Ultra™ from Novo Nordisk, or Lipomax™ from Genencor. Suitable amylases are sold under the tradename Purafact Ox Am™ described in WO-A-94/18314, WO-A-96/05295 sold by Genencor; Termamyl™, Fungamyl™ and Duramyl™, all available from Novo Nordisk A/S and those described in WO-A-95/26397.

Preferred cellulytic enzymes are sold under the tradename Carezyme™, Celluzyme™ and/or Endolase™ by Novo Nordisk A/S. A suitable peroxidase is sold as Guardzyme™ available from Novo Nordisk A/S.

Detergency enzymes are commonly employed in granular form in amounts of from about 0.1 to about 3.0 wt %.

(i) Other Ingredients

The compositions of the invention may also contain alkali metal, preferably sodium, carbonate, in order to increase detergency and ease processing. Sodium carbonate may suitably be present in amounts ranging from 1 to 60 wt %, preferably from 2 to 40 wt.

Powder flow may be improved by the incorporation of a small amount of a powder structurant, for example, a fatty acid (or fatty acid soap), a sugar, an acrylate or acrylate/maleate polymer, or sodium silicate. One preferred powder structurant is fatty acid soap, suitably present in an amount of from 1 to 5 wt %.

The detergent compositions according to the present invention may also comprise from 0.001% to 10%, more preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash. Especially suitable polymeric dye transfer inhibiting agents are polyamine N-oxide polymers, copolymers of N-vinylpyrrolidone and N-vinylimidazole, polyvinylpyrrolidone polymers, polyvinyl-oxazolidones and polyvinylimidazoles or mixtures thereof.

Soil release agents useful in compositions of the present invention are conventionally copolymers or terpolymers of terephthalic acid with ethylene glycol and/or propylene glycol units in various arrangements. Examples of such polymers are disclosed in U.S. Pat. Nos. 4,116,885, 4,711,730 and EP-A-272 033.

Other materials that may be present in detergent compositions of the invention include sodium silicate; anti-redeposition agents such as cellulosic polymers; inorganic salts such as sodium sulphate, lather control agents or lather boosters as appropriate, enzyme stabilizers, corrosion inhibitors, dyes, coloured speckles, perfumes, suds depressants, germicides, anti-tarnishing agents, opacifiers, optical brighteners, foam controllers, and fabric softening compounds. This list is not intended to be exhaustive.

Detergent compositions of the invention may be prepared by any suitable method. Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Such powders may be prepared either by post-tower densification of spray-dried powder, or by wholly non-tower methods such as dry mixing and granulation; in both cases a high-speed mixer/granulator may advantageously be used. Processes using high-speed mixer/granulators for preparing high-bulk density detergent powders are disclosed, for example, in EP-A-340 013, EP-A-367 339, EP-A-390 251 and EP-A-420 317 (Unilever).

The invention will now be further illustrated in the following, non-limiting Example.

EXAMPLE 1

Bleaching of Tomato Stains

The potential of the enhancer, Ethanedioic acid, 2-[(4-aminophenyl)sulfonyl)hydrazide-2-phenylhydrazide, to boost the bleach performance of phenol oxidizing enzyme was assessed by washing cotton swatches soiled with tomato stains The experiments were performed in small 100 ml containers, to which 15 ml of wash solution were added (indicated in tables). Purified phenol oxidizing enzyme from *Acremonium murorum* was added to the wash solution at 100 mg/l. The enzyme from *Acremonium murorum* is described in WO-A-00/05349 (Unilever). The enhancer was dosed at 250 $\mu$M. The following formulation was used as wash solution (2 g/l):

| Detergent Composition | |
|---|---|
| LAS | 24% |
| STP | 14.5% |
| Soda ash | 17.5% |
| silicate | 8.0% |
| SCMC | 0.37% |
| Blue pigment | 0.02% |
| Moisture/salts | 34.6% |

The swatches were washed during 1 hour at 30° C. After the wash, the swatches were tumble-dried and the reflectance spectra were measured using a Minolta spectrometer. The color differences between the swatch before and after the wash data were expressed in the CIELAB L*a*b* color space. In this color space, L* indicates lightness and a* and b* are the chromaticity coordinates. Color differences between two swatches are expressed as ΔE, which is calculated from the following equation:

$$\Delta E=\sqrt{\Delta L^2+\Delta a^2+\Delta b^2}$$

The results, as ΔE values, are shown in Table 1 below:

Table 1: Stain bleach performance of the phenol oxidizing enzyme/enhancer system on tomato stains in the presence of different enhancers.

| | |
|---|---|
| Wash enzyme only | ΔE = 8.7 |
| Wash with enhancer only | ΔE = 9.1 |
| Wash with enzyme and enhancer added | ΔE = 11.9 |

As can be seen from the ΔE values, the bleaching of the tomato stain is improved in the presence of the phenol oxidizing enzyme/enhancer system.

EXAMPLE 2

Stain bleach experiments were performed as in Example 1, except that 20 mg/l enzymes was used. The detergent formulation was set at pH 9, and the swatches washed during 30 minutes at 30 C.

Table 2: Stain bleach performance of the phenol oxidizing enzyme/enhancer system on tomato stains in the presence of the enzymatic bleach system.

| | |
|---|---|
| Wash without enzymatic bleach system | ΔE = 2.7 |
| Wash with enzyme and enhancer added | ΔE = 10.6 |

As can be seen from the ΔE values, the bleaching of the tomato stain is improved in the presence of the phenol oxidizing enzyme/enhancer system.

What is claimed is:

1. Process for enhancing the activity of a phenol oxidizing enzyme, comprising adding to the enzyme, as an enhancer for the activity of said enzyme, one or more compounds having the formula:

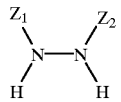

wherein $Z_1$ and $Z_2$ are electron withdrawing groups, independently selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile.

2. Process according to claim 1, wherein the enhancer has the formula:

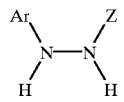

wherein Z is as defined before and Ar is an optionally substituted aromatic or heteroaromatic group.

3. Process according to claim 1, wherein the enhancer has the formula:

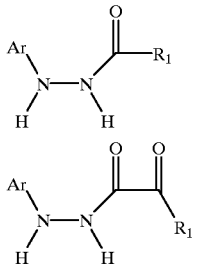

wherein the Ar group is defined before and $R_1$ is an optionally substituted alkyl, oxyalkyl, aryl or oxyaryl group.

4. Process according to claim 1, wherein the enhancer is selected from the group consisting of 2'-phenylbenzohydrazide; ethyl[2-(3-chlorophenyl)] hydrazide oxalate; propyl[2-phenyl]-hydrazide oxalate; methyl[2-phenyl]-hydrazide oxalate and N,N'-diphenylethane dihydrazine.

5. Process according to claim 1, wherein the enhancer has the formula:

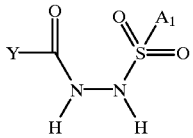

wherein Y=optionally substituted aryl or aryl-hydrazidoyl, -amidoyl, -esteroyl, alkanoyl, aroyl, alkyl, aryl and $A_1$=optionally substituted (hetero)aryl or alkyl.

6. Process according to claim 1, wherein the enhancer has the formula:

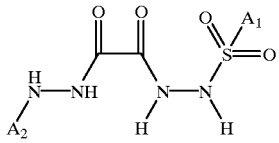

wherein $A_1$ and $A_2$ are independently optionally substituted (hetero)aryl or alkyl.

7. Process according to claim 6, wherein $A_1$ is unsubstituted or para substituted aryl with substitutents nitro, chloro, bromo, fluoro, amino, alkylamido, C1–C6 alkyl optionally branched and substituted, C1–C6 alkoxy optionally branched and substituted, carbamoyl, sulfamoyl, sulfonyl, formyl, carboxyl and esters and salts thereof.

8. Process according to claim 1, wherein the enhancer is Ethanedioic acid, 2-[(4-aminophenyl)sulfonyl)hydrazide-2-phenylhydrazide.

9. An enzymatic bleach composition comprising: (a) a phenol oxidizing enzyme (b) an enhancer having the formula

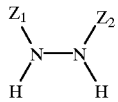

wherein $Z_1$ and $Z_2$ are electron withdrawing groups, independently selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile.

10. An enzymatic bleach composition according to claim 9, comprising an enzyme exhibiting peroxidase activity and a source of hydrogen peroxide.

11. An enzymatic bleach composition according to claim 9, comprising an enzyme exhibiting peroxidase activity and an alkali metal percarbonate.

12. An enzymatic bleach composition according to claim 9, comprising from 0.001 to 10 mM hydrogen peroxide.

13. A bleaching detergent composition comprising one or more surfactants and an enzymatic bleach composition comprising: (a) a phenol oxidizing enzyme (b) an enhancer having the formula

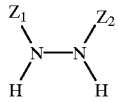

wherein $Z_1$ and $Z_2$ are electron withdrawing groups, independently selected from the group consisting of optionally substituted alkyl/(hetero)aryl- -sulfone, -sulfoxide, -sulfonate, -carbonyl, -oxalyl, -amidoxalyl, -hydrazidoxalyl, -carboxyl and esters and salts thereof, -amidyl, -hydrazidyl, nitrile.

14. A bleaching detergent composition according to claim 13, further comprising a proteolytic enzyme.

15. A bleaching detergent composition according to claim 13, further comprising a subtilisin protease.

16. A bleaching detergent composition according to claims 13, in the form of a granular detergent composition.

17. Process for removing coloured stains from fabrics in a washing process comprising contacting the stained fabric, in an aqueous medium, with an enzymatic bleach composition according to claim 9.

18. Process for removing coloured stains from fabrics in a washing process comprising contacting the stained fabric, in an aqueous medium, with a bleaching detergent composition according to claim 13.

* * * * *